US010161065B2

(12) United States Patent
Ogata et al.

(10) Patent No.: US 10,161,065 B2
(45) Date of Patent: Dec. 25, 2018

(54) CLOTH AND TEXTILE PRODUCT

(71) Applicant: TEIJIN FRONTIER CO., LTD., Osaka-shi, Osaka (JP)

(72) Inventors: Nobuaki Ogata, Osaka (JP); Satoshi Yasui, Ibaraki (JP)

(73) Assignee: TEIJIN FRONTIER CO., LTD., Osaka (JP)

( * ) Notice: Subject to any disclaimer, the term of this patent is extended or adjusted under 35 U.S.C. 154(b) by 973 days.

(21) Appl. No.: 14/387,287

(22) PCT Filed: Dec. 11, 2013

(86) PCT No.: PCT/JP2013/083151

§ 371 (c)(1),
(2) Date: Sep. 23, 2014

(87) PCT Pub. No.: WO2014/097935

PCT Pub. Date: Jun. 26, 2014

(65) Prior Publication Data

US 2015/0050438 A1 Feb. 19, 2015

(30) Foreign Application Priority Data

Dec. 17, 2012 (JP) ..... 2012-274667

(51) Int. Cl.
*D02G 3/04* (2006.01)
*D04B 1/24* (2006.01)
(Continued)

(52) U.S. Cl.
CPC ..... *D02G 3/045* (2013.01); *D02G 3/26* (2013.01); *D03D 13/008* (2013.01); *D03D 15/00* (2013.01); *D04B 1/16* (2013.01); *D04B 1/22* (2013.01); *D04B 1/24* (2013.01); *D06M 15/277* (2013.01); *D06M 15/507* (2013.01); *D04B 21/20* (2013.01); *D10B 2321/021* (2013.01); *D10B 2321/022* (2013.01); *D10B 2331/04* (2013.01);
(Continued)

(58) Field of Classification Search
None
See application file for complete search history.

(56) References Cited

U.S. PATENT DOCUMENTS 7,622,188 B2 11/2009 Kamiyama et al.
7,654,071 B2 2/2010 Yoshimoto et al.
(Continued)

FOREIGN PATENT DOCUMENTS

CN 102443953 A 5/2012
EP 2037026 A1 3/2009
(Continued)

OTHER PUBLICATIONS

Machine translation of JP2009299207, Yasui et al., Dec. 2009.*
(Continued)

*Primary Examiner* — Shawn Mckinnon
(74) *Attorney, Agent, or Firm* — Sughrue Mion, PLLC

(57) ABSTRACT

An object of the invention is to provide a cloth having water absorbency, water repellency, and a tendency to float on water, and also a textile product using the cloth. A means of resolution is to obtain a cloth using a fiber A that is not water repellent and a fiber B that is water repellent in a weight ratio (fiber A:fiber B) within a range of 50:50 to 87:13.

22 Claims, 2 Drawing Sheets

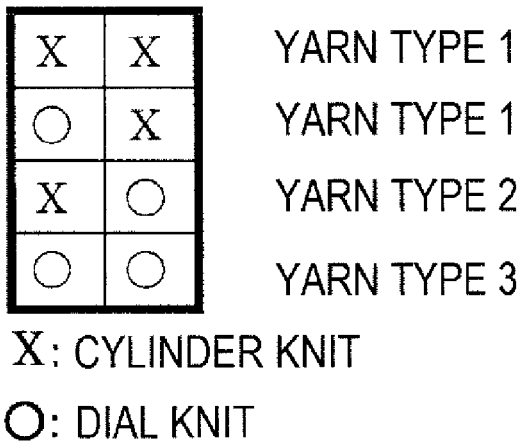

(51) Int. Cl.

| | |
|---|---|
| ***D03D 15/00*** | (2006.01) |
| ***D06M 15/277*** | (2006.01) |
| ***D06M 15/507*** | (2006.01) |
| ***D04B 1/22*** | (2006.01) |
| ***D02G 3/26*** | (2006.01) |
| ***D04B 1/16*** | (2006.01) |
| ***D03D 13/00*** | (2006.01) |
| *D04B 21/20* | (2006.01) |

(52) U.S. Cl.

CPC .. *D10B 2401/021* (2013.01); *D10B 2401/022* (2013.01); *D10B 2501/00* (2013.01); *D10B 2501/043* (2013.01); *D10B 2503/02* (2013.01); *D10B 2503/06* (2013.01); *D10B 2505/10* (2013.01); *D10B 2505/12* (2013.01); *D10B 2505/18* (2013.01); *Y10T 428/1334* (2015.01); *Y10T 428/249921* (2015.04); *Y10T 442/3976* (2015.04); *Y10T 442/40* (2015.04)

(56) References Cited

U.S. PATENT DOCUMENTS

| | | | |
|---|---|---|---|
| 7,682,994 | B2 | 3/2010 | Van Emden et al. |
| 7,910,207 | B2 | 3/2011 | Kamiyama et al. |
| 8,276,405 | B2 | 10/2012 | Ogata |
| 2006/0223400 | A1 | 10/2006 | Yasui et al. |
| 2007/0032155 | A1 | 2/2007 | Patterson |
| 2007/0196649 | A1 | 8/2007 | Kamiyama et al. |
| 2008/0096001 | A1 | 4/2008 | Emden et al. |
| 2009/0004469 | A1 | 1/2009 | Yoshimoto et al. |
| 2009/0308107 | A1 | 12/2009 | Ogata |
| 2010/0029158 | A1 | 2/2010 | Kamiyama et al. |
| 2012/0207955 | A1 | 8/2012 | Ogata et al. |
| 2013/0239289 | A1 | 9/2013 | Iwashita |

FOREIGN PATENT DOCUMENTS

| | | | |
|---|---|---|---|
| JP | 441750 | A | 2/1992 |
| JP | 491240 | A | 3/1992 |
| JP | 06-173171 | A | 6/1994 |
| JP | H9195172 | A | 7/1997 |
| JP | 2001-279507 | A | 10/2001 |
| JP | 2002-223899 | A | 8/2002 |
| JP | 2002363843 | A | 12/2002 |
| JP | 2004-156174 | A | 6/2004 |
| JP | 2004211268 | A | 7/2004 |
| JP | 2004270097 | A | 9/2004 |
| JP | 2005-48372 | A | 2/2005 |
| JP | 2005-105424 | A | 4/2005 |
| JP | 2006-167153 | A | 6/2006 |
| JP | 2006-225784 | A | 8/2006 |
| JP | 2007-092190 | A | 4/2007 |
| JP | 2007-191812 | A | 8/2007 |
| JP | 2007247096 | * | 9/2007 |
| JP | 2008-63700 | A | 3/2008 |
| JP | 2008-509289 | A | 3/2008 |
| JP | 2009-144257 | A | 7/2009 |
| JP | 2009-299201 | A | 12/2009 |
| JP | 2009299207 | * | 12/2009 |
| JP | 2010-31404 | A | 2/2010 |
| JP | 2010138507 | A | 6/2010 |
| JP | 2010-174403 | A | 8/2010 |
| JP | 2010-201811 | A | 9/2010 |
| JP | 2011-47068 | A | 3/2011 |
| JP | 2011-132643 | A | 7/2011 |
| JP | 2011-256495 | A | 12/2011 |
| JP | 2012-1849 | A | 1/2012 |
| JP | 2012-7272 | A | 1/2012 |
| JP | 2012-122144 | A | 6/2012 |
| JP | 2012-184520 | A | 9/2012 |
| JP | 2012-214969 | A | 11/2012 |
| JP | 2013-083008 | A | 5/2013 |
| TW | 218896 | B | 1/1994 |
| TW | M392828 | U1 | 11/2010 |
| TW | I339226 | B | 3/2011 |
| TW | 201229343 | A1 | 7/2012 |
| WO | 2005095686 | A1 | 10/2005 |
| WO | 2006025610 | A1 | 3/2006 |
| WO | 2008001920 | A1 | 1/2008 |
| WO | 2011048888 | A1 | 4/2011 |

OTHER PUBLICATIONS

Machine translation of JP2007247096, Seki, Sep. 2007.*

Pastore et al. (Surface Characteristics of Fibers and Textiles, pp. 54, 2000). (Year: 2000).*

Communication dated Jun. 9, 2015, issued by the European Patent Office in counterpart Application No. 13864266.5.

Communication dated Jun. 23, 2015, issued by the European Patent Office in counterpart 13864266.5.

International Search Report of PCT/JP2013/083151 dated Mar. 18, 2014.

Communication dated Apr. 24, 2017, issued by the European Patent Office in counterpart Application No. 13864266.5.

Salas et al., "Water-Wettable Polypropylene Fibers by Facile Surface Treatment Based on Soy Proteins", ACS Applied Materials & Interfaces, vol. 5, No. 14, Jul. 24, 2013, pp. 6541-6548, XP055301017 (8 pages total).

Dr. Tuckermann, "Fluide Grenzflachen", May 1, 2006, pp. 1-35, Retrieved from Internet: URL:http://www:pci.tu-bs.de/aggericke/PC5-Grenzf/Fluide_Grenzflaechen.pdf (35 pages total).

* cited by examiner

[FIG. 1]

| | | |
|---|---|---|
| X | X | YARN TYPE 1 |
| ○ | X | YARN TYPE 1 |
| X | ○ | YARN TYPE 2 |
| ○ | ○ | YARN TYPE 3 |

X: CYLINDER KNIT

○: DIAL KNIT

[FIG. 2]

| | | | | |
|---|---|---|---|---|
| | ○ | | ○ | YARN TYPE 1 |
| X | | X | Y | YARN TYPE 1 |
| | ○ | | ○ | YARN TYPE 2 |
| X | Y | X | | YARN TYPE 1 |

X: CYLINDER KNIT

○: DIAL KNIT

Y: DIAL TUCK

[FIG. 3]

| | | | | |
|---|---|---|---|---|
| X | | X | | YARN TYPE 2 |
| X | X | X | X | YARN TYPE 1 |
| | X | | X | YARN TYPE 3 |
| X | X | X | X | YARN TYPE 1 |

X: CYLINDER KNIT

[FIG. 4]

| | | | | |
|---|---|---|---|---|
| ◎ | ◎ | ◎ | ◎ | YARN TYPE 1 * YARN TYPE 2 |
| ◎ | ◎ | ◎ | ◎ | YARN TYPE 1 * YARN TYPE 3 |

◎: PLATING KNIT

[FIG. 5]

L1 10/12 YARN TYPE 1

L2 44/00 YARN TYPE 2

L3 23/10 YARN TYPE 3

[FIG. 6]

| | | | | |
|---|---|---|---|---|
| | ○ | | ○ | YARN TYPE 1 |
| X | | X | Y | YARN TYPE 1 |
| | ○ | | ○ | YARN TYPE 1 |
| X | Y | X | | YARN TYPE 1 |
| | ○ | | ○ | YARN TYPE 1 |
| X | | X | Y | YARN TYPE 1 |
| | ○ | | ○ | YARN TYPE 2 |
| X | Y | X | | YARN TYPE 1 |

X: CYLINDER KNIT

○: DIAL KNIT

Y: DIAL TUCK

CLOTH AND TEXTILE PRODUCT

TECHNICAL FIELD

The present invention relates to a cloth having water absorbency, water repellency, and a tendency to float on water, and also to a textile product using the cloth.

BACKGROUND ART

Conventionally, cloths using synthetic fibers have been widely used for ordinary garments, sportswear, etc. In addition, methods for improving the wearing comfort of such a cloth have been proposed, such as a method in which the single-yarn fineness of the cloth-forming synthetic fiber is reduced, or the cloth is subjected to water-absorbing processing, thereby improving the water absorbency of the cloth (see, e.g., PTL 1), and a method in which the cloth is subjected to water-repelling processing, thereby imparting water repellency (see, e.g., PTL 2).

However, water absorbency and water repellency are conflicting properties. Accordingly, few proposals have been made for cloths which are excellent in terms of both properties.

In addition, in recent years, competitions played both on land and in water, such as triathlon, have been held. However, few proposals have been made for wear which tends float on water and is suitable for such competitions.

CITATION LIST

Patent Literature

PTL 1: JP-A-2002-363843
PTL 2: JP-A-9-195172

SUMMARY OF INVENTION

Technical Problem

The invention has been accomplished in view of the above background. An object of the invention is to provide a cloth having water absorbency, water repellency, and a tendency to float on water, and also a textile product using the cloth.

Solution to Problem

The present inventors have conducted extensive research to achieve the above object. As a result, they have found that when a cloth is made using a fiber that is not water repellent and a fiber that is water repellent, and the weight ratio between the fibers and their arrangement are devised, a cloth having water absorbency, water repellency, and a tendency to float on water can be obtained. They have further conducted extensive research and accomplished the invention.

Thus, the invention provides "a cloth containing a fiber A that is not water repellent and a fiber B that is water repellent, characterized in that the weight ratio between the fiber A and the fiber B(fiber A:fiber B) is within a range of 50:50 to 87:13."

Note that the fiber A that is not water repellent is a fiber having a contact angle of less than 120°, and the fiber B that is water repellent is a fiber having a contact angle of 120° or more.

In this case, it is preferable that the cloth is knitted or woven using the fiber A that is not water repellent and the fiber B that is water repellent. It is also preferable that the cloth has a water absorption rate of 30 seconds or less on at least one surface thereof as measured in accordance with JIS L1096, 6.26 Water Absorption Rate, Method A (Dropping Method). It is also preferable that the cloth has a sedimentation time of 10 seconds or more as measured in accordance with JIS L1907-2010, 7.1.3 Sedimentation Method. It is also preferable that the fiber A is a polyester fiber. It is also preferable that the fiber A has a single-yarn fineness of 1.5 dtex or less. It is also preferable that the fiber A is a multifilament made of 30 or more filaments. It is also preferable that the fiber A is a false-twist crimped yarn. It is also preferable that the fiber A is a false-twist crimped yarn having a torque of 30 T/m or less. It is also preferable that the fiber B is at least one member selected from the group consisting of a water-repellent polyester fiber, a polypropylene fiber, a polyethylene fiber, and a polyvinyl chloride fiber. In this case, it is preferable that the water-repellent polyester fiber is a polyester fiber copolymerized or blended with a silicone compound, a fluorine compound, or a hydrocarbon compound or a polyester fiber subjected to water-repelling processing using a fluorine water-repellent agent, a silicone water-repellent agent, or a hydrocarbon water-repellent agent. In this case, it is preferable that the fluorine water-repellent agent is a fluorine water-repellent agent containing perfluorooctanoic acid and perfluorooctanesulfonic acid at a concentration of 5 ng/g or less. It is also preferable that in the cloth, the yarn cross-sectional porosity of the fiber B is 50% or more. It is also preferable that the fiber B is a false-twist crimped yarn. It is also preferable that the fiber B is a false-twist crimped yarn having a torque of 30 T/m or less. It is also preferable that the single-yarn fineness of the fiber B is greater than the single-yarn fineness of the fiber A. It is also preferable that at least one of the fiber A and the fiber B is a modified cross-section fiber. It is also preferable that the cloth is a knitted fabric. It is also preferable that the cloth satisfies at least one of the following requirements (1) to (6):

(1) the cloth is a weft-knitted fabric, in which the fiber B is exposed on both surfaces of the cloth, and, on the both surfaces of the cloth, the occupancy of loops of the fiber B is within a range of 25 to 75%;

(2) the cloth is a weft-knitted fabric, in which the fiber B is exposed on only one surface of the cloth, and, on the surface of the cloth, the occupancy of loops of the fiber B is within a range of 40 to 100%;

(3) the cloth is a single weft-knitted fabric, in which the fiber A is used for the entire needle structure, while the fiber A and the fiber B are used for a knit-miss and tuck-knit structure, and, in the cloth, loops of the fiber A are joined to each other in the course direction in at least one wale per ten wales;

(4) the cloth is a reversible weft-knitted fabric, in which the fiber A is plated with the fiber B;

(5) the cloth is a reversible warp-knitted fabric, in which the needle side is made only of the fiber A, and the sinker side is made of the fiber B or both the fiber A and the fiber B;

(6) the cloth is a multilayer woven fabric, in which the fiber B is laid on only one side of the multilayer woven fabric.

In the cloth of the invention, it is also preferable that the fiber A is exposed on one surface of the cloth, and the fiber B is exposed on the other surface of the cloth. It is also preferable that when a photograph of a cross-section of the fiber B is taken from a cross-section of the cloth with an electron microscope, and the total area (SF) of the single-yarn cross-section and the total area (SA) of voids in the photograph are measured, the yarn cross-sectional porosity calculated by the following equation is 50% or more:

$$\text{yarn cross-sectional porosity } (\%) = SA/(SA+SF) \times 100.$$

In the cloth of the invention, it is preferable that the cloth has been subjected to water-absorbing processing. It is also preferable that the cloth has an areal weight of 200 g/m$^2$ or less. It is also preferable that the cloth has a thickness of 1.0 mm or less.

The invention also provides a textile product using the cloth mentioned above, selected from the group consisting of garments, artificial leathers, shoes, bags, curtains, tents, sleeping bags, waterproof sheets, and car seats.

Advantageous Effects

The invention enables the provision of a cloth having water absorbency, water repellency, and a tendency to float on water, and also a textile product using the cloth.

BRIEF DESCRIPTION OF DRAWINGS

FIG. 1 shows the knitting structure pattern used in Example 1.

FIG. 2 shows the knitting structure pattern used in Example 2.

FIG. 3 shows the knitting structure pattern used in Example 3.

FIG. 4 shows the knitting structure pattern used in Example 4 and Comparative Example 3.

FIG. 5 shows the knitting structure pattern used in Example 5.

FIG. 6 shows the knitting structure pattern used in Comparative Example 1 and Comparative Example 2.

DESCRIPTION OF EMBODIMENTS

Hereinafter, embodiments of the invention will be described in detail.

First, the cloth of the invention contains a fiber A that is not water repellent and a fiber B that is water repellent. Note that in the context of the invention, the "fiber that is not water repellent" is a fiber having a contact angle of less than 120°, and the "fiber that is water repellent" is a fiber having a contact angle of 120° or more. Incidentally, the contact angle is to be measured as follows. Using distilled water, 500 pl of distilled water is dropped onto the single-yarn surface of a fiber, and the resulting contact angle between the fiber and the water droplet is measured by the θ/2 method.

Here, the fiber A that is not water repellent is a fiber that contributes to water absorbency in the invention. The kind of fiber is not particularly limited and may be a polyester fiber, a nylon fiber, a natural fiber such as cotton or wool, or the like, but is preferably a polyester fiber.

Preferred examples of polyester fibers include those made of polyethylene terephthalate, polytrimethylene terephthalate, polybutylene terephthalate, polylactic acid, stereocomplex polylactic acid, a polyester copolymerized with a third component, and the like. Incidentally, the polyester may also be a polyester obtained by material recycling or chemical recycling or polyethylene terephthalate obtained using a monomer component produced from a biomass raw material, i.e., a substance of biological origin. Further, it may also be a polyester obtained using a catalyst containing a specific phosphorus compound or titanium compound as described in JP-A-2004-270097 or JP-A-2004-211268.

As long as the object of the invention is not impaired, the polymer forming the polyester fiber may contain one or more kinds of delusterants, antibacterial agents, micropore-forming agents, cationic dye dyeable agents, coloring inhibitors, heat stabilizers, fluorescent brighteners, colorants, moisture absorbents, inorganic fine particles, heat storage agents, and the like as necessary. For example, when a delusterant is added to the polymer contained in the polymer to give a semi-dull polyester or a full-dull polyester, the cloth can be provided with anti-see-through properties or IR/UV-blocking properties, and thus this is preferable. As antibacterial agents, in addition to natural antibacterial agents and inorganic antibacterial agents, it is also possible to use an acid-treated polyester copolymerized with an ester-forming metal sulfonate compound or an ester-forming phosphonium sulfonate compound as described in WO 2011/048888.

With respect to the form of the fiber A, it may be a short fiber or a long fiber (multifilament), but is preferably a long fiber (multifilament) in terms of obtaining excellent water absorbency. In particular, when the fiber has a single-yarn fineness of 1.5 dtex or less (more preferably 0.0001 to 1.2 dtex, particularly preferably 0.001 to 0.9 dtex), excellent water absorbency is obtained, and thus this is preferable. In particular, when the fiber is a multifilament made of 30 or more filaments (more preferably 70 to 200 filaments), even more excellent water absorbency is obtained, and thus this is preferable. In this case, it is preferable that the total fineness of the multifilament is within a range of 30 to 200 dtex (more preferably 30 to 150 dtex). The fiber A may also be a microfiber having a single-yarn fiber diameter of 1 μm or less, so-called "nanofiber", as described in WO 2005/095686.

In terms of improving water absorbency, the fiber A may also be a false-twist crimped yarn obtained by false-twist crimping a multifilament, an air-textured yarn, or a composite yarn obtained by air-blending or composite false-twist texturing two or more kinds of constituent yarns. Further, it may also be a side-by-side latently crimped fiber. In addition, the fiber A may also be a composite fiber whose crimp degree changes upon wetting as described in WO 2006/025610.

In particular, when the fiber A is a false-twist crimped yarn (preferably a false-twist crimped yarn having 70 or more filaments), excellent water absorbency is obtained, and thus this is preferable. The single-fiber transverse cross-sectional shape of the fiber A is not particularly limited. In addition to round, it may also be a modified cross-sectional shape such as triangular, flat, flat with constrictions as described in WO 2008/001920, or hollow. In addition, when it is a composite yarn having a torque of 30 T/m or less (composite false-twist crimped yarn) obtained by combining a false-twist crimped yarn having a torque in the S-direction and a false-twist crimped yarn having a torque in the Z-direction, followed by an air-interlacing treatment, as described in WO 2008/001920, voids are formed in the cloth, whereby a tendency to float on water is improved, and thus this is preferable.

Meanwhile, in the invention, the fiber B that is water repellent is a fiber that contributes to water repellency and the tendency to float on water. The kind of fiber B is preferably a water-repellent polyester fiber, a polypropylene fiber, a polyethylene fiber, a polyvinyl chloride fiber, or the like. These fibers all have excellent water repellency. Therefore, when a cloth having a specific structure is knitted or woven using such a fiber B and the fiber A mentioned above, the resulting cloth has water absorbency, water repellency, and the tendency to float on water.

Here, it is preferable that the water-repellent polyester fiber is a polyester fiber copolymerized or blended with a silicone compound, a fluorine compound, or a hydrocarbon compound or a polyester fiber subjected to water-repelling processing using a silicone, hydrocarbon, or fluorine water-repellent agent. In this case, it is preferable that the amount of copolymerization or blending is 5 to 25 wt % relative to the weight of polyester. In addition, in the polyester fiber subjected to water-repelling processing, it is preferable that the content of water-repellent agent is 0.4 wt % or more (more preferably 0.4 to 10 wt %) relative to the weight of polyester fiber before processing.

In this case, it is preferable that the fluorine water-repellent agent is a fluorine water-repellent agent containing perfluorooctanoic acid and perfluorooctanesulfonic acid at a total concentration of 5 ng/g or less (preferably 0 ng/g). Examples of such fluorine water-repellent agents include perfluoroalkyl-acrylate copolymers made only of monomers having no N-methylol groups and commercially available products. Preferred examples of commercially available products include AsahiGuard E-SERIES AG-E061, a fluorinated water/oil repellent agent, manufactured by Asahi Glass Co., Ltd., and SCOTCHGARD PM3622, PM490, and PM930 manufactured by Sumitomo 3M Limited.

Incidentally, the method for producing the water-repellent polyester fiber is not particularly limited and may be a known method. The method for producing a polyester fiber copolymerized or blended with a silicone compound or a fluorine compound may be, for example, the method described in JP-A-2010-138507. Meanwhile, the method of water-repelling processing may be, for example, a method in which a fluorine water-repellent agent is mixed with an antistatic agent, a melamine resin, a catalyst, and the like as necessary, and the resulting processing agent is applied to a polyester fiber by padding, spraying, or the like.

Here, as the method for subjecting a polyester fiber to water-repelling processing, water-repelling processing in the fiber stage is preferable to water-repelling processing in the cloth stage. As compared with the case where water-repelling processing is performed in the cloth stage, in the case where water-repelling processing is performed in the fiber stage, single fibers are covered with the water-repellent agent, whereby the total covered area increases, and the durability of water-repellency is improved; thus this is preferable.

With respect to the form of the fiber B, it may be a short fiber or a long fiber (multifilament). However, when the fiber B is a long fiber (multifilament), voids tend to be formed between fibers B, and such voids tend to provide the tendency to float on water; thus this is preferable. In particular, in terms of obtaining excellent water absorbency through capillary action, it is preferable that the single-yarn fineness of the fiber B is greater than the single-yarn fineness of the fiber A. It is preferable that the single-yarn fineness is 1.0 to 5.0 dtex (more preferably 1.5 to 3.0 dtex). With respect to the number of filaments and the total fineness of the fiber B, it is preferable that the number of filaments is 20 or more (more preferably 20 to 200), and the total fineness is 30 to 200 dtex (more preferably 30 to 150 dtex).

The fiber B may also be a false-twist crimped yarn obtained by false-twist crimping a multifilament, an air-textured yarn, a composite yarn obtained by air-blending or composite false-twist texturing two or more kinds of constituent yarns, or a composite yarn having a torque of 30 T/m or less as mentioned above. In particular, when the fiber B is a false-twist crimped yarn (preferably a false-twist crimped yarn made of 20 or more filaments), voids tend to be formed between fibers B, and such voids tend to provide the tendency to float on water; thus this is preferable. In this case, it is preferable that the crimp degree of the false-twist crimped yarn is 3% or more. The single-fiber transverse cross-sectional shape of the fiber B is not particularly limited. In addition to round, it may also be a modified cross-sectional shape such as triangular, flat, flat with constrictions as described in WO 2008/001920, or hollow, etc.

In the cloth of the invention, it is important that the weight ratio between the fiber A and the fiber B (fiber A:fiber B) is within a range of 50:50 to 87:13. When the weight proportion of the fiber A is less than the range, this may lead to a decrease in the water absorbency of the cloth and thus is undesirable. On the other hand, when the weight proportion of the fiber B is less than the range, this may lead to a decrease in water repellency and the tendency to float on water and thus is undesirable.

In the cloth of the invention, the cloth structure is not particularly limited. For example, examples of weft-knitting structures (circular-knitting structures) include plain stitch, rib stitch, interlock stitch, purl stitch, tuck stitch, float stitch, half cardigan stitch, lace stitch, pile stitch, single-side binding stitch, knit-miss stitch, and reversible plain stitch. Examples of warp-knitting structures include back inlay stitch, single denbigh stitch, single atlas stitch, double cord stitch, half stitch, half base stitch, satin stitch, half tricot stitch, fleece stitch, and jacquard stitch. Examples of woven fabric structures include three foundation weaves including plain, twill, and satin, modifications thereof, half double weaves such as warp-backed weave and weft-backed weave, and warp velvet. Further, the cloth may also be a nonwoven fabric. Needless to say, the invention is not limited thereto. Also with respect to the number of layers, it may be a single-layer structure or a multilayer structure including two or more layers.

In particular, when the cloth satisfies at least one of the following requirements (1) to (6), voids tend to be formed between fibers B. This tends to provide water absorbency, water repellency, and the tendency to float on water, and thus is preferable.

(1) The cloth is a weft-knitted fabric, in which the fiber B is exposed on both surfaces of the cloth, and, on the both surfaces of the cloth, the occupancy of loops of the fiber B is within a range of 25 to 75%.

(2) The cloth is a weft-knitted fabric, in which the fiber B is exposed on only one surface of the cloth, and, on the surface of the cloth, the occupancy of loops of the fiber B is within a range of 40 to 100%.

(3) The cloth is a single weft-knitted fabric, in which the fiber A is used for the entire needle structure, while the fiber A and the fiber B are used for a knit-miss and tuck-knit structure, and, in the cloth, loops of the fiber A are joined to each other in the course direction in at least one wale per ten wales.

(4) The cloth is a reversible weft-knitted fabric, in which the fiber A is plated with the fiber B.

(5) The cloth is a reversible warp-knitted fabric, in which the needle side is made only of the fiber A, and the sinker side is made of the fiber B or both the fiber A and the fiber B.

(6) The cloth is a multilayer woven fabric, in which the fiber B is laid on only one side of the multilayer woven fabric.

In particular, it is preferable that the fiber A is exposed on one surface of the cloth, and the fiber B is exposed on the other surface of the cloth. It is also preferable that the fiber B is exposed on at least one surface of the cloth, and, on the surface having exposed thereon the fiber B, the yarn cross-sectional porosity of the fiber B is 50% or more. This is because in such a case, voids tend to be formed between single fibers of the fiber B, and such voids tend to provide the tendency to float on water. Incidentally, the porosity can be measured by the following method.

(Porosity Measurement Method)

A photograph of a cross-section of the fiber B is taken from a cross-section of the cloth with an electron microscope. The total area (SF) of the single-yarn cross-section and the total area (SA) of voids in the photograph are measured, and the porosity is calculated by the following equation:

$$\text{yarn cross-sectional porosity } (\%)=SA/(SA+SF)\times 100.$$

In the cloth of the invention, with respect to the weaving/knitting density of the cloth, in terms of improving water absorbency, water repellency, and the tendency to float on water, it is preferable that the cloth is a knitted fabric having a knitting density of 30 to 150 courses/2.54 cm and 20 to 130 wales/2.54 cm or a woven fabric having a cover factor CF of 300 to 3500 (more preferably 300 to 1000) as defined by the following equation:

$$CF=(DWp/1.1)^{1/2}\times MWp+(DWf/1.1)^{1/2}\times MWf$$

[DWp is warp-yarn total fineness (dtex), MWp is warp-yarn weaving density (yarns/2.54 cm), DWf is weft-yarn total fineness (dtex), and MWf is weft-yarn weaving density (yarns/2.54 cm)].

The cloth of the invention can be produced using the fiber A and the fiber B using an ordinary weaving machine or knitting machine. In addition, the cloth may be suitably subjected to ordinary post-processing, such as dyeing, weight reduction, napping, calendering, embossing, heat-storing processing, water-absorbing processing, or antibacterial processing. In particular, in terms of obtaining excellent water absorbency, it is preferable to perform water-absorbing processing. As an example of the method of water-absorbing processing, it is preferable that the cloth is processed at the time of dyeing in the same bath using a hydrophilizing agent, such as PEG diacrylate, a derivative thereof, or a polyethylene terephthalate-polyethylene glycol copolymer.

In the cloth thus obtained, it is preferable that the areal weight of the cloth is 200 g/m$^2$ or less (more preferably 50 to 200 g/m$^2$). When the areal weight is more than 200 g/m$^2$, the cloth is heavy, and the wearing comfort of the cloth may be impaired. In addition, it is preferable that the thickness of the cloth is 1.0 mm or less (more preferably 0.35 to 0.65 mm).

The cloth of the invention has water absorbency, water repellency, and the tendency to float on water. In particular, when the fiber B is exposed on at least one surface as mentioned above, sweat is quickly absorbed by the cloth surface, resulting in excellent water absorbency (sweat absorbency). At the same time, because the surface having exposed thereon the fiber B is water repellent, the cloth has sweat-absorbing and quick-drying effects and is also effective in preventing the body from getting cold after sweating, preventing stickiness, etc. Further, when the cloth has the above structure, the fiber B does not absorb water, and, in addition, voids tend to be formed between fibers B. Such voids improve the tendency to float on water.

Here, as water absorbency, it is preferable that the water absorption rate measured in accordance with JIS L1096, 6.26 Water Absorption Rate, Method A (Dropping Method), is 30 seconds or less (more preferably 0 to 30 seconds) on at least one surface (preferably both front and back surfaces) of the cloth.

In addition, as an alternative property for water repellency and the tendency to float on water, it is preferable that the sedimentation time measured in accordance with JIS L1907-2010, 7.1.3 Sedimentation Method, is 10 seconds or more (more preferably 10 to 300 seconds).

Next, the textile product of the invention is a textile product using the above cloth, selected from the group consisting of garments, artificial leathers, shoes, bags, curtains, tents, sleeping bags, waterproof sheets, and car seats. Incidentally, the garments include amphibious wear, sportswear, outdoor wear, linings, raincoats, men's garments, women's garments, workwear, protective suits, underwear, down garments, etc.

The textile product uses the above cloth and thus is excellent in terms of water absorbency, water repellency, and the tendency to float on water.

For example, when a garment is made with the surface having exposed thereon the fiber B (in the case where the synthetic fiber B is exposed on both surfaces of the cloth, the surface having a larger amount of fiber B exposed) used on the body side, sweat is quickly absorbed, resulting in excellent sweat-absorbing and quick-drying properties. At the same time, because such a surface is water repellent, the garment is effective in preventing the body from getting cold after sweating, preventing stickiness, etc. Further, because of the tendency to float on water, the garment is also suitable as amphibious wear.

EXAMPLES

Examples of the invention and comparative examples will be described in detail, but the invention is not limited thereto.

(1) Measurement Method for Areal Weight

Measurement was performed in accordance with JIS L1018 6.4.

(2) Measurement Method for Thickness

Measurement was performed in accordance with JIS L1018 6.5.

(3) Measurement Method for Loop Number Percentage

Loop number percentage (%)=the number of loops made of exposed fiber B (A)/the number of loops on the entire surface×100

(4) Water Absorption Rate (Dropping Method)

Measurement was performed in accordance with JIS L1096, 6.26 Water Absorption Rate, Method A (Dropping Method).

(5) Sedimentation Time of Cloth

As an alternative property for water repellency, the sedimentation time of the cloth was measured in accordance with JIS L1907-2010, 7.1.3 Sedimentation Method. At that time, the surface having a larger amount of fiber B exposed was brought into contact with water. A cloth with a longer sedimentation time is more excellent in terms of water repellency. In addition, a cloth with a longer sedimentation time is more excellent in terms of the tendency to float on water. When the sedimentation time is 10 seconds or more, such a cloth is rated as excellent in terms of water repellency and the tendency to float on water.

(6) Porosity of Fiber B

A photograph of a cross-section of the fiber B was taken from a cross-section of the cloth with an electron microscope. The total area (SF) of the single-yarn cross-section and the total area (SA) of voids in the photograph were measured, and the porosity was calculated by the following equation:

$$\text{yarn cross-sectional porosity } (\%) = SA/(SA+SF) \times 100.$$

(7) Measurement of Fiber Contact Angle

Using a fiber extracted from the finally obtained cloth, an automatic microscopic contact angle meter "MCA-2" manufactured by Kyowa Interface Science Co., Ltd., and distilled water, 500 pl of distilled water was dropped onto the single-yarn surface of the fiber, and the resulting contact angle between the fiber and the water droplet was measured by the θ/2 method.

Example 1

Using a circular-knitting 28G double machine, a knitted fabric having the structure pattern shown in FIG. 1 was obtained using a normal semi-dull polyethylene terephthalate multifilament false-twist crimped yarn of 84 dtex/72 fil (fiber A) as Yarn Type 1, a silicone-water-repellent-agent-copolymerized water-repellent semi-dull polyethylene terephthalate multifilament false-twist crimped yarn of 84 dtex/36 fil copolymerized with 5.5 wt % of a silicone compound (fiber B) as Yarn Type 2, and a normal semi-dull polyethylene terephthalate multifilament false-twist crimped yarn of 84 dtex/36 fil (fiber A) as Yarn Type 3. Incidentally, the term "normal" above means that "it has not been subjected to special processing, such as water-repelling processing."

Subsequently, in the dyeing step, the knitted fabric was processed in the same bath using a hydrophilizing agent (polyethylene terephthalate-polyethylene glycol copolymer) to impart water absorbency to the knitted fabric.

The obtained knitted fabric had excellent water absorbency and water repellency, and also had a tendency to float on water. Evaluation results are shown in Table 1.

Subsequently, amphibious triathlon wear was made using the knitted fabric (cloth) such that the side having laid thereon the fiber B was on the body side, and worn. As a result, the wear had water absorbency, water repellency, and a tendency to float on water.

In addition, sportswear was made using the knitted fabric (cloth) such that the side having laid thereon the fiber B was on the body side, and worn. As a result, the wear had sweat-absorbing and quick-drying effects and was also effective in preventing the body from getting cold after sweating, preventing stickiness, etc.

Example 2

Using a circular-knitting 28G double machine, a knitted fabric having the structure pattern shown in FIG. 2 was obtained using a normal semi-dull polyethylene terephthalate multifilament false-twist crimped yarn of 84 dtex/72 fil (fiber A) as Yarn Type 1 and the same silicone-water-repellent-agent-copolymerized water-repellent semi-dull polyethylene terephthalate multifilament false-twist crimped yarn of 84 dtex/36 fil as in Example 1 (fiber B) as Yarn Type 2.

Subsequently, in the dyeing step, the knitted fabric was processed in the same bath using a hydrophilizing agent (polyethylene terephthalate-polyethylene glycol copolymer) to impart water absorbency to the knitted fabric.

The obtained knitted fabric had excellent water absorbency and water repellency, and also had a tendency to float on water. Evaluation results are shown in Table 1.

Subsequently, amphibious triathlon wear was made using the knitted fabric (cloth) such that the side having laid thereon the fiber B was on the body side, and worn. As a result, the wear had water absorbency, water repellency, and the tendency to float on water.

In addition, sportswear was made using the knitted fabric (cloth) such that the side having laid thereon the fiber B was on the body side, and worn. As a result, the wear had sweat-absorbing and quick-drying effects and was also effective in preventing the body from getting cold after sweating, preventing stickiness, etc.

Example 3

Using a circular-knitting 36G single machine, a knitted fabric having the structure pattern shown in FIG. 3 was obtained using a normal semi-dull polyethylene terephthalate multifilament false-twist crimped yarn of 56 dtex/72 fil (fiber A) as Yarn Type 1, a normal semi-dull polyethylene terephthalate multifilament false-twist crimped yarn of 56 dtex/72 fil (fiber A) as Yarn Type 2, and a polypropylene multifilament false-twist crimped yarn of 56 tex/30 fil (fiber B) as Yarn Type 3.

Subsequently, in the dyeing step, the knitted fabric was processed in the same bath using a hydrophilizing agent (polyethylene terephthalate-polyethylene glycol copolymer) to impart water absorbency to the knitted fabric.

The obtained knitted fabric had excellent water absorbency and water repellency, and also had a tendency to float on water. Evaluation results are shown in Table 1.

Subsequently, amphibious triathlon wear was made using the knitted fabric (cloth) such that the side having laid thereon the fiber B was on the body side, and worn. As a result, the wear had water absorbency, water repellency, and the tendency to float on water.

In addition, sportswear was made using the knitted fabric (cloth) such that the side having laid thereon the fiber B was on the body side, and worn. As a result, the wear had sweat-absorbing and quick-drying effects and was also effective in preventing the body from getting cold after sweating, preventing stickiness, etc.

Example 4

Using a circular-knitting 28G single machine, a knitted fabric having the structure pattern shown in FIG. 4 was obtained using a normal semi-dull polyethylene terephthalate multifilament false-twist crimped yarn of 110 dtex/144 fil (fiber A) as Yarn Type 1, a normal semi-dull polyethylene terephthalate multifilament false-twist crimped yarn of 84 dtex/36 fil (fiber A) as Yarn Type 2, and a fluorine-water-repellent-agent-copolymerized water-repellent semi-dull polyethylene terephthalate multifilament false-twist crimped yarn of 56 tex/36 fil copolymerized with 7.5 wt % of a fluorine compound (fiber B) as Yarn Type 3.

Subsequently, in the dyeing step, the knitted fabric was processed in the same bath using a hydrophilizing agent (polyethylene terephthalate-polyethylene glycol copolymer) to impart water absorbency to the knitted fabric.

The obtained knitted fabric had excellent water absorbency and water repellency, and also had a tendency to float on water. Evaluation results are shown in Table 1.

Subsequently, amphibious triathlon wear was made using the knitted fabric (cloth) such that the side having laid thereon the fiber B was on the body side, and worn. As a result, the wear had water absorbency, water repellency, and the tendency to float on water.

In addition, sportswear was made using the knitted fabric (cloth) such that the side having laid thereon the fiber B was on the body side, and worn. As a result, the wear had sweat-absorbing and quick-drying effects and was also effective in preventing the body from getting cold after sweating, preventing stickiness, etc.

Example 5

Using a warp-knitting 28G machine, a knitted fabric having the structure pattern shown in FIG. 5 was obtained using a normal semi-dull polyethylene terephthalate multifilament false-twist crimped yarn of 33 dtex/12 fil (fiber A) as Yarn Type 1, a semi-dull polyethylene terephthalate multifilament false-twist crimped yarn of 84 tex/36 fil subjected to the following water-repelling processing (fiber B) as Yarn Type 2, and a normal semi-dull polyethylene terephthalate multifilament false-twist crimped yarn of 56 dtex/72 fil (fiber A) as Yarn Type 3.

Subsequently, in the dyeing step, the knitted fabric was processed in the same bath using a hydrophilizing agent (polyethylene terephthalate-polyethylene glycol copolymer) to impart water absorbency to the knitted fabric.

The obtained knitted fabric had excellent water absorbency and water repellency, and also had a tendency to float on water. Evaluation results are shown in Table 1.

Subsequently, amphibious triathlon wear was made using the knitted fabric (cloth) such that the side having laid thereon the fiber B was on the body side, and worn. As a result, the wear had water absorbency, water repellency, and the tendency to float on water.

In addition, sportswear was made using the knitted fabric (cloth) such that the side having laid thereon the fiber B was on the body side, and worn. As a result, the wear had sweat-absorbing and quick-drying effects and was also effective in preventing the body from getting cold after sweating, preventing stickiness, etc.

(Conditions for Water-Repelling Processing)

Kind of Water-Repellent Agent: Fluorine compound (trade name: AsahiGuard E-SERIES AG-E061)

Incidentally, the fluorine compound is a fluorine water-repellent agent containing perfluorooctanoic acid and perfluorooctanesulfonic acid at a concentration of 0 ng/g.

Processing Conditions: Bath ratio 1:8, using a 0.6 wt % solution, treated at a temperature of 45° C. for a duration of 10 minutes Processing Method: Exhaustion processing in a bath using a cheese dyeing machine Comparative Example 1

Using a circular-knitting 28G double machine, a knitted fabric having the structure pattern shown in FIG. 6 was obtained using a normal semi-dull polyethylene terephthalate multifilament false-twist crimped yarn of 84 dtex/72 fil (fiber A) as Yarn Type 1, a normal semi-dull polyethylene terephthalate multifilament false-twist crimped yarn of 84 dtex/72 fil (fiber A) as Yarn Type 2, and the same silicone-water-repellent-agent-copolymerized water-repellent semi-dull polyethylene terephthalate multifilament false-twist crimped yarn of 84 dtex/36 fil as in Example 1 (fiber B) as Yarn Type 3.

Subsequently, in the dyeing step, the knitted fabric was processed in the same bath using a hydrophilizing agent (polyethylene terephthalate-polyethylene glycol copolymer) to impart water absorbency to the knitted fabric.

The obtained knitted fabric had excellent water absorbency, but was inferior in terms of water repellency and a tendency to float on water.

Comparative Example 2

Using a circular-knitting 28G double machine, a knitted fabric having the structure pattern shown in FIG. 6 was obtained using a normal semi-dull polyethylene terephthalate multifilament false-twist crimped yarn of 84 dtex/72 fil (fiber A) as Yarn Type 1, a normal semi-dull polyethylene terephthalate multifilament false-twist crimped yarn of 84 dtex/72 fil (fiber A) as Yarn Type 2, and a normal semi-dull polyethylene terephthalate multifilament false-twist crimped yarn of 84 dtex/72 fil (fiber A) as Yarn Type 3.

Subsequently, in the dyeing step, the knitted fabric was processed in the same bath using a hydrophilizing agent (polyethylene terephthalate-polyethylene glycol copolymer) to impart water absorbency to the knitted fabric.

The obtained knitted fabric had excellent water absorbency, but was inferior in terms of water repellency and a tendency to float on water.

Comparative Example 3

Using a circular-knitting 28G single machine, a knitted fabric having the structure pattern shown in FIG. 4 was obtained using a normal semi-dull polyethylene terephthalate multifilament false-twist crimped yarn of 110 dtex/144 fil (fiber A) as Yarn Type 1 and a normal semi-dull polyethylene terephthalate multifilament false-twist crimped yarn of 84 dtex/36 fil as Yarn Types 2 and 3 (fiber A).

Subsequently, in the dyeing step, the knitted fabric was processed in the same bath using a hydrophilizing agent (polyethylene terephthalate-polyethylene glycol copolymer) to impart water absorbency to the knitted fabric.

The obtained knitted fabric had excellent water absorbency, but was inferior in terms of water repellency and a tendency to float on water.

TABLE 1

| | Example 1 | Example 2 | Example 3 | Example 4 | Example 5 | Comparative Example 1 | Comparative Example 2 | Comparative Example 3 |
|---|---|---|---|---|---|---|---|---|
| Fabric Type | Circular knitting, Double | Circular knitting, Double | Circular knitting, Single | Circular knitting, Single | Warp knitting | Circular knitting, Double | Circular knitting, Double | Circular knitting, Single |
| Gauge | 28 G | 28 G | 36 G | 28 G | 28 G | 28 G | 28 G | 28 G |
| Structure | Reversible stitch (FIG. 1) | Single-side knot (FIG. 2) | Knit-miss structure (FIG. 3) | Reversible plain stitch (FIG. 4) | Inlay stitch (FIG. 5) | Single-side knot (FIG. 6) | Single-side knot (FIG. 6) | Reversible plain stitch (FIG. 4) |
| Yarn Type 1 | SD84T72 DTY (Fiber A) | SD84T72 DTY (Fiber A) | SD56T72 DTY (Fiber A) | Plain stitch: SD110T144 DTY | SD33T12 DTY (Fiber A) | SD84T72 DTY (Fiber A) | SD84T72 DTY (Fiber A) | Plain stitch: SD110T144 DTY |

TABLE 1-continued

| | Example 1 | Example 2 | Example 3 | Example 4 | Example 5 | Comparative Example 1 | Comparative Example 2 | Comparative Example 3 |
|---|---|---|---|---|---|---|---|---|
| Yarn Type 2 | Water-repellent PET SD84T36 DTY (Fiber B) | Water-repellent PET SD84T36 (Fiber B) | SD56T36 DTY (Fiber A) | (Fiber A) PL1: SD84T36 DTY (Fiber A) | Water-repellent PET SD84T36 DTY (Fiber B) | Water-repellent PET SD84T36 (Fiber B) | SD84T36 DTY (Fiber A) | (Fiber A) PL1: SD84T36 DTY (Fiber A) |
| Yarn Type 3 | SD84T36 DTY (Fiber A) | — | Poly-propylene SD56T30 DTY (Yarn B) | PL2: Water-repellent PET SD56T36 DTY (Fiber B) | SD56T72 DTY (Fiber A) | — | — | PL2: SD84T36 DTY (Fiber A) |
| Contact Angle (°) (Yarn Type 1) | 110 | 110 | 115 | 115 | 110 | 110 | 110 | 115 |
| Contact Angle (°) (Yarn Type 2) | 143 | 138 | 108 | 105 | 135 | 138 | 105 | 105 |
| Contact Angle (°) (Yarn Type 3) | 105 | — | 140 | 145 | 115 | — | — | 105 |
| Wight Proportion of Yarn B Mixed (%) | 35 | 20 | 25 | 18 | 15 | 12 | 0 | 0 |
| Areal Weight ($g/m^2$) | 135 | 130 | 125 | 155 | 170 | 130 | 135 | 153 |
| Density (course/wale) | 55/45 | 50/40 | 90/72 | 55/45 | 55/45 | 50/40 | 52/41 | 54/43 |
| Thickness (mm) | 0.51 | 0.55 | 0.42 | 0.50 | 0.53 | 0.54 | 0.52 | 0.51 |
| Wicking (sec) | Front: 10 Back: 12 | Front: 1.2 Back: 3.5 | Front: 5.2 Back: 8.5 | Front: 2.5 Back: 3.2 | Front: 1.5 Back: 4.2 | Front: 1.0 Back: 2.5 | Front: 1.2 Back: 1.0 | Front: 1.2 Back: 1.0 |
| Porosity of Yarn B (%) | 55 | 72 | 65 | 57 | 62 | 72 | — | — |
| Time of Cloth Floating on Water (sec) | 35 | 45 | More than 60 | 16 | 35 | 5 | 1 | 2 |
| Cy Side: Occupancy of Loops of Yarn B (%) | 25 | 0 | — | — | 0 | 0 | — | — |
| Di Side: Occupancy of Loops of Yarn B (%) | 25 | 50 | — | — | 100 | 25 | — | — |

Incidentally, in the table, the unit of the number of courses and the number of wales is the number/2.54 cm. In addition, in a knitted fabric containing the fiber B, the surface having a larger amount of fiber B exposed is the back, and the other side is the front.

INDUSTRIAL APPLICABILITY

The invention provides a cloth having water absorbency, water repellency, and the tendency to float on water, and also a textile product using the cloth. The industrial value thereof is extremely high.

The invention claimed is:

1. A cloth comprising a fiber A that is not water repellent and a fiber B that is water repellent, characterized in that the weight ratio between the fiber A and the fiber B (fiber A:fiber B) is within a range of 50:50 to 87:13 and the fiber A has a contact angle of 105° to less than 120°, and the fiber B has a contact angle of 135° or more, wherein the contact angle is to be measured as follows: using distilled water, 500 pl of distilled water is dropped onto the single-yarn surface of a fiber, and the resulting contact angle between the fiber and the water droplet is measured by the θ/2 method, and the fiber B is a water-repellent polyester fiber, and the fiber B is a false-twist crimped yarn having a torque of 30 T/m or less, and the cloth has a water absorption rate of 30 seconds or less on at least one surface thereof as measured in accordance with JIS L1096, 6.26 Water Absorption Rate, Method A, Dropping Method, and the cloth has a sedimentation time of 10 seconds or more as measured in accordance with JIS L1907-2010, 7.1.3 Sedimentation Method.

2. The cloth according to claim 1, knitted or woven using the fiber A that is not water repellent and the fiber B that is water repellent.

3. The cloth according to claim 1, wherein the fiber A is a polyester fiber.

4. The cloth according to claim 1, wherein the fiber A has a single-yarn fineness of 1.5 dtex or less.

5. The cloth according to claim 1, wherein the fiber A is a multifilament made of 30 or more filaments.

6. The cloth according to claim 1, wherein the fiber A is a false-twist crimped yarn.

7. The cloth according to claim 1, wherein the fiber A is a false-twist crimped yarn having a torque of 30 T/m or less.

8. The cloth according to claim 1, wherein the fiber B is a water-repellent polyester fiber that is a polyester fiber subjected to water-repellent processing using a fluorine water-repellent agent that is a fluorine water-repellent agent containing perfluorooctanoic acid and perfluorooctanesulfonic acid at a total concentration of 5 ng/g or less.

9. The cloth according to claim 1, wherein the single-yarn fineness of the fiber B is greater than the single-yarn fineness of the fiber A.

10. The cloth according to claim 1, wherein at least one of the fiber A and the fiber B is a modified cross-section fiber.

11. The cloth according to claim 1, wherein the cloth is a knitted fabric.

12. The cloth according to claim 1, wherein the cloth satisfies at least one of the following requirements (1) to (6):

(1) the cloth is a weft-knitted fabric, in which the fiber B is exposed on both surfaces of the cloth, and, on the both surfaces of the cloth, the occupancy of loops of the fiber B is within a range of 25 to 75%;

(2) the cloth is a weft-knitted fabric, in which the fiber B is exposed on only one surface of the cloth, and, on the surface of the cloth, the occupancy of loops of the fiber B is within a range of 40 to 100%;

(3) the cloth is a single weft-knitted fabric, in which the fiber A is used for the entire needle structure, while the fiber A and the fiber B are used for a knit-miss and tuck-knit structure, and, in the cloth, loops of the fiber A are joined to each other in the course direction in at least one wale per ten wales;

(4) the cloth is a reversible weft-knitted fabric, in which the fiber A is plated with the fiber B;

(5) the cloth is a reversible warp-knitted fabric, in which the needle side is made only of the fiber A, and the sinker side is made of the fiber B or both the fiber A and the fiber B;

(6) the cloth is a multilayer woven fabric, in which the fiber B is laid on only one side of the multilayer woven fabric.

13. The cloth according to claim 1, wherein the fiber A is exposed on one surface of the cloth, and the fiber B is exposed on the other surface of the cloth.

14. The cloth according to claim 1, wherein when a photograph of a cross-section of the fiber B is taken from a cross-section of the cloth with an electron microscope, and the total area (SF) of a single-yarn cross-section and the total area (SA) of voids in the photograph are measured, the yarn cross-sectional porosity calculated by the following equation is 50% or more:

$$\text{yarn cross-sectional porosity } (\%) = SA/(SA+SF) \times 100.$$

15. The cloth according to claim 1, wherein the cloth has been subjected to water-absorbing processing.

16. The cloth according to claim 1, wherein the cloth has an areal weight of 200 g/m$^2$ or less.

17. The cloth according to claim 1, wherein the cloth has a thickness of 1.0 mm or less.

18. A textile product using the cloth of claim 1, selected from the group consisting of garments, artificial leathers, shoes, bags, curtains, tents, sleeping bags, waterproof sheets, and car seats.

19. The cloth according to claim 1, wherein the water-repellent polyester fiber is a polyester fiber copolymerized or blended with a silicone compound, a fluorine compound, or a hydrocarbon compound or a polyester fiber subjected to water-repelling processing using a fluorine water-repellent agent, a silicone water-repellent agent, or a hydrocarbon water-repellent agent.

20. The cloth according to claim 1, wherein the fiber B is a water-repellent polyester fiber that is a polyester fiber copolymerized or blended with a fluorine compound or a hydrocarbon compound or a polyester fiber subjected to water-repelling processing using a fluorine water-repellent agent or a hydrocarbon water-repellent agent.

21. The cloth according to claim 12, wherein the cloth satisfies at least one of the following requirements (1) to (5):

(1) the cloth is a weft-knitted fabric, in which the fiber B is exposed on both surfaces of the cloth, and, on the both surfaces of the cloth, the occupancy of loops of the fiber B is within a range of 25 to 75%;

(2) the cloth is a weft-knitted fabric, in which the fiber B is exposed on only one surface of the cloth, and, on the surface of the cloth, the occupancy of loops of the fiber B is within a range of 40 to 100%;

(3) the cloth is a single weft-knitted fabric, in which the fiber A is used for the entire needle structure, while the fiber A and the fiber B are used for a knit-miss and tuck-knit structure, and, in the cloth, loops of the fiber A are joined to each other in the course direction in at least one wale per ten wales;

(4) the cloth is a reversible weft-knitted fabric, in which the fiber A is plated with the fiber B;

(5) the cloth is a reversible warp-knitted fabric, in which the needle side is made only of the fiber A, and the sinker side is made of the fiber B or both the fiber A and the fiber B.

22. The cloth according to claim 1, wherein the cloth has a knit-miss structure.

* * * * *